US007345465B2

(12) United States Patent
Dequina et al.

(10) Patent No.: US 7,345,465 B2
(45) Date of Patent: Mar. 18, 2008

(54) TWO PIN-BASED SENSING OF REMOTE DC SUPPLY VOLTAGE DIFFERENTIAL USING PRECISION OPERATIONAL AMPLIFIER AND DIFFUSED RESISTORS

(75) Inventors: Noel B. Dequina, Flemington, NJ (US); Robert Haynes Isham, Flemington, NJ (US)

(73) Assignee: Intersil Americas Inc., Milpitas, CA (US)

( * ) Notice: Subject to any disclaimer, the term of this patent is extended or adjusted under 35 U.S.C. 154(b) by 67 days.

(21) Appl. No.: 11/423,479

(22) Filed: Jun. 12, 2006

(65) Prior Publication Data

US 2007/0285076 A1 Dec. 13, 2007

(51) Int. Cl.
*G05F 3/10* (2006.01)
*G05F 1/40* (2006.01)

(52) U.S. Cl. ..... 323/316; 323/280; 323/281

(58) Field of Classification Search ..... 323/312, 323/313, 314, 315, 316, 280, 281
See application file for complete search history.

(56) References Cited

U.S. PATENT DOCUMENTS 6,002,276 A * 12/1999 Wu ..... 323/316
6,066,944 A * 5/2000 Sakurai ..... 323/315
6,351,110 B1 * 2/2002 Pappalardo et al. ..... 323/316
2005/0083027 A1 * 4/2005 Kikuchi ..... 323/315

* cited by examiner

*Primary Examiner*—Jessica Han
(74) *Attorney, Agent, or Firm*—Fogg & Powers LLC

(57) ABSTRACT

A DC power supply control apparatus monitors respective terminals supplying positive and negative DC supply voltages to a utility device. The voltage at the negative terminal is compared with a target value for that voltage to produce an offset current representative of any voltage differential therebetween. This offset current is used to produce an offset voltage, that is added to or subtracted from a target value of the positive supply voltage to produce an error amplifier reference voltage. This reference voltage is compared with the voltage at the monitored positive terminal, to produce an error voltage, in response to which the power supply's modulator loop adjusts the power supply's positive output voltage, as necessary, to maintain the intended DC voltage differential between the positive and negative DC supply voltages.

17 Claims, 1 Drawing Sheet

TWO PIN-BASED SENSING OF REMOTE DC SUPPLY VOLTAGE DIFFERENTIAL USING PRECISION OPERATIONAL AMPLIFIER AND DIFFUSED RESISTORS

FIELD OF THE INVENTION

The present invention relates in general to DC power supply systems and subsystems thereof, and is particularly directed to a DC power supply control apparatus, having first and second input pins through which respective values of negative and positive DC voltages being supplied to a utility device are monitored. Using the first input pin, the voltage at the negative terminal is monitored and compared with a target value of the voltage for the negative terminal to produce a current representative of any voltage differential therebetween. This current is then used to produce an offset voltage, that is added to or subtracted from the target value of the positive DC supply voltage to produce an error amplifier reference voltage. The error amplifier compares this error amplifier reference voltage (which effectively represents any offset in the negative DC supply voltage) with the voltage at the monitored positive terminal, to produce an error voltage. This error voltage is then used by the power supply's modulator loop to adjusts the power supply's positive DC output voltage, so as to maintain the intended DC voltage differential between positive and negative supply rails.

BACKGROUND OF THE INVENTION

Power supply systems for supplying DC power to a device, such as core processors of digital processing devices, and the like, which are subject to varying load conditions, must continuously monitor the respective voltages at (remote) power supply terminals to which the powered device is coupled, in order to compensate for voltage drops associated with the resistance of the main DC output power rails and ground planes, and thereby ensure that the powered device will be continuously supplied with its intended target voltage differential. Typical monitoring and control circuits that have been employed for this purpose include three pin-based circuits.

SUMMARY OF THE INVENTION

In accordance with the present invention, there is provided a new and improved DC power supply control subsystem, which is configured as a two input pin-based architecture, having first and second DC voltage supply rail-sensing input pins. A first, negative voltage rail sensing input pin is adapted to be coupled to a first remote power supply terminal through which a first DC supply rail voltage, such as ground potential, is supplied to a first power supply terminal of the powered device. A second, positive voltage rail sensing input pin is adapted to be coupled to a second remote power supply terminal through which a second DC supply rail voltage, having a prescribed DC voltage value (e.g., +3.3 VDC), that is positive relative to the first voltage, is supplied to a second power supply terminal of the powered device.

The first, negative voltage rail sensing input pin is coupled through a first input resistor to a non-inverting input of a precision operational amplifier. The inverting input of the operational amplifier is coupled through a second input (sense) resistor to a reference potential, which corresponds to the potential of the first DC supply rail voltage (ground).

The operational amplifier's output controls the (gate) drive for and thereby the (source-drain) current through a current flow control device (e.g., MOSFET) of an offset current generator. This offset current generator is operative to derive an offset current representative of the voltage differential between the first (negative) DC supply rail voltage and its associated reference potential (e.g., ground), and is used to produce an offset voltage for adjusting the second supply voltage in accordance with this current.

For this purpose, the derived current is supplied to an input current reference node, to which the inverting input of the operational amplifier is coupled, and which serves as the input current for a first current mirror circuit. The output current mirrored by the first current mirror circuit is coupled to an output current reference node. The input current reference node is further coupled to the input of a reference current source, which is operative to generate a prescribed reference current that is coupled to a second current mirror circuit, the mirrored reference output current of which is coupled to the output current reference node.

The output current reference node, which is coupled to the reference terminal of an error amplifier that is used to control the operation of the power supply's pulse width modulator (PWM) for maintaining the positive supply rail voltage at its intended value, is coupled through an output reference resistor to a voltage terminal, such as the output of a digital-to-analog converter (DAC), to which a voltage representative of the target value of the positive voltage is applied. Any mismatch of the output currents produced by the two current mirror circuits (as a result of an offset in the monitored negative rail voltage from its target value (e.g., ground)) will cause a current (representative of this voltage offset) to flow into or out of the output current reference node and through the output reference resistor to produce a voltage drop thereacross.

This voltage drop or 'offset' is added or subtracted to the voltage representative of the target value of the positive voltage, so as to produce a modified positive voltage reference with which the error amplifier compares the monitored positive DC supply rail voltage. As a result, any adjustment of the positive output voltage by the DC power supply's correction loop will not only depend upon whether or not the positive DC supply rail is at its target value, but will depend upon whether or not the negative DC supply rail is at its target value, thereby ensuring that the intended differential between the positive and negative supply rails is maintained.

Namely, as long as the value of the negative supply voltage applied to the first input pin is at its target value (e.g., ground potential), the two inputs of the operational amplifier will have a zero voltage differential therebetween, so that the output of the operational amplifier will be zero. As a result, the current flow control MOSFET of the current generator will be slightly turned on, so as to provide a prescribed quiescent source-drain current therethrough that is equal to the current generated by the reference current source. This means that the input current to the first current mirror circuit will be equal and opposite to the input current (the reference current generated by the reference current source) to the second current mirror circuit, so that the input currents to the two current mirror circuits will be mutually complementary, whereby their mirrored output currents supplied to the output current reference node will sum to zero. As a consequence, no current will flow out of or into the output current reference node by way of the output reference resistor to which the voltage representative of the target value of the positive DC supply rail is coupled. With no current flowing (in either direction) through the output reference resistor, there will be no 'offset' voltage drop thereacross, so that the positive voltage reference for the error amplifier will correspond to the target value of the positive DC supply rail.

On the other hand, if the value of the negative supply voltage applied to the first input pin is not at its target value, the output of the operational amplifier will change accordingly, so as to cause the magnitude of source-drain current flowing through the current generator's current control MOSFET to the input current reference node to depart from its quiescent value (the value current generated by the reference current source). This change in the magnitude of the source-drain current through the current control MOSFET causes current to flow either in a first direction from the input current reference node through the second input resistor to ground, or in a second direction from ground through the second input resistor into input current reference node, depending upon the polarity of the change in monitored voltage.

Namely, a change in the sensed negative voltage is effectively converted into an equivalent current (the current through the second input resistor) that is proportional to the voltage change in the negative voltage as monitored at the first input pin. The direction and magnitude of this equivalent current is defined by the relatively simple relationship I=V−/Rsense, and is such as to bring the voltage V− applied to the inverting input terminal of the operational amplifier into balance with the change in sensed remote voltage coupled to the first input of the operational amplifier.

The change in source-drain current through the current control MOSFET necessary to bring the voltage V− at the operational amplifier's inverting input into balance with the change in the sensed negative voltage supply rail is mirrored at the output of the first current mirror circuit, and results in a mismatch in the magnitudes of the mirrored output currents supplied by the two current mirror circuits to the output current reference node. This causes a current equal to the magnitude of the mismatch to flow either out of or into the output current reference node through the reference resistor, with the direction of current flow depending upon whether the change in the sensed negative voltage rail at the first input terminal is positive or negative relative to its ground reference.

As pointed out above, this current flow through the reference resistor will cause the voltage at the output current reference node to be offset from (either higher or lower than) the target value of the positive DC power supply voltage, so as to modify the reference voltage for the error amplifier. As a result, any adjustment of the positive output voltage by the DC power supply's correction loop will now be governed by whether or not the positive DC supply rail voltage corresponds to a modified value of the target positive rail voltage, which takes into account any detected offset in the negative DC supply rail from its target value, thereby ensuring that the intended differential between the positive and negative supply rails is maintained.

BRIEF DESCRIPTION OF THE DRAWING

The single FIGURE is a schematic illustration of a two input pin-based remote differential voltage sensing architecture in accordance with a preferred embodiment of the invention.

DETAILED DESCRIPTION

Figure 1:
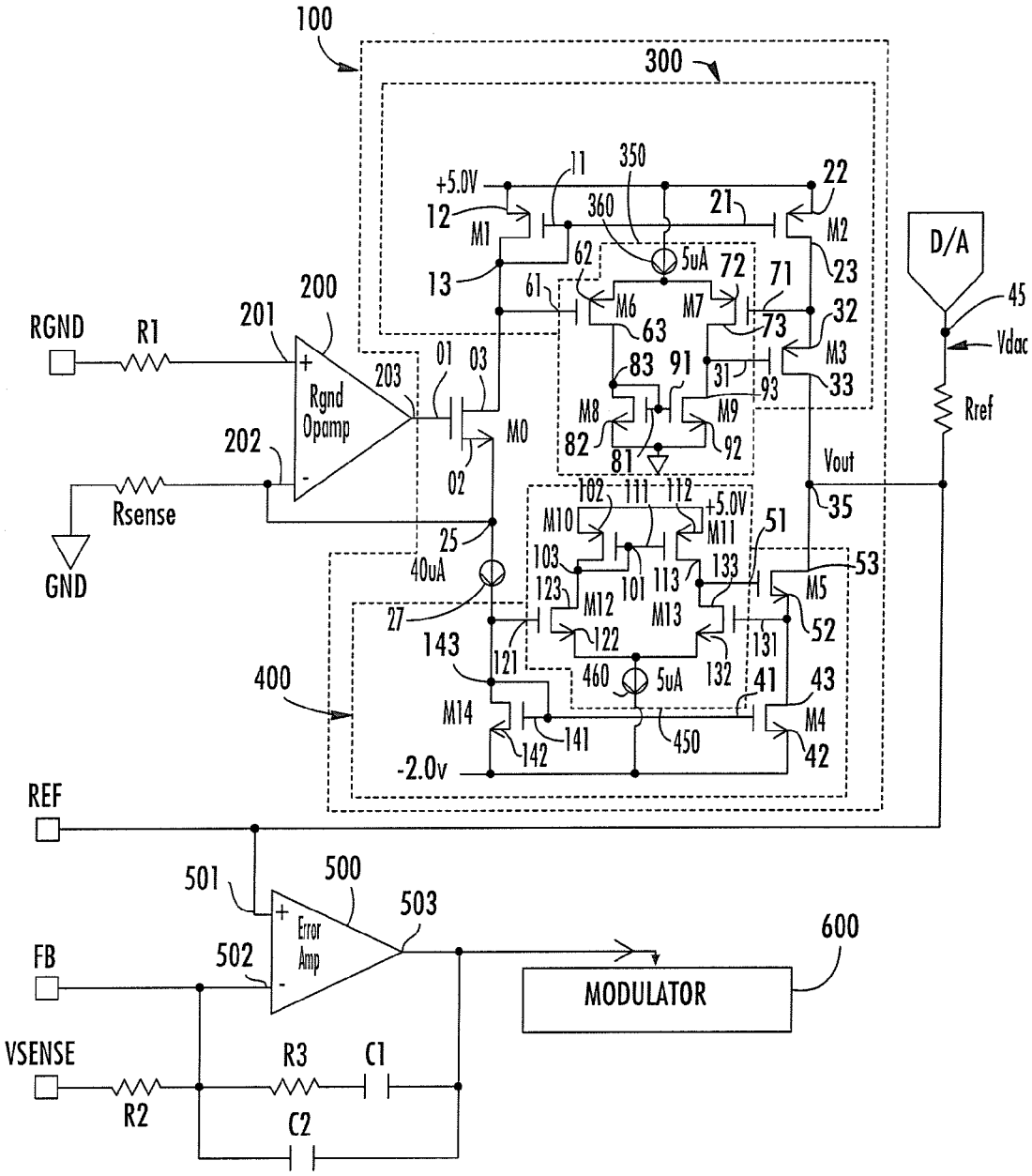

Attention is now directed to the single FIGURE, wherein a preferred embodiment of a two input pin-based remote differential voltage sensing architecture in accordance with of the present invention is schematically illustrated. As shown therein, the differential voltage sensing architecture includes a first (negative voltage rail sensing) input pin, shown as a first remote voltage sensing terminal RGND, which is adapted to be coupled to a first remote power supply terminal through which a first supply rail voltage, such as ground (GND) potential, is supplied to a first power supply terminal of the powered device, such as a core processor of a personal computer. The differential voltage sensing architecture of the invention also includes a second (positive voltage rail sensing) input pin, shown as a second remote voltage sensing terminal VSENSE, which is adapted to be coupled to a second remote power supply terminal through which a second supply rail voltage, having some prescribed DC voltage value (e.g., +3.3 VDC) that is positive relative to the first voltage (e.g., ground), is supplied to a second power supply terminal of the powered device.

The first remote voltage sensing terminal RGND is coupled through a first input resistor R1 to a first, non-inverting (+), input terminal 201 of a precision operational amplifier (op amp) 200 having a very low offset voltage. Input resistor R1 serves to provide compensation for the inherent input bias current to the op amp's input terminal 201. A second, inverting (−), input terminal 202 of the op amp is coupled through a second input resistor Rsense (which may be implemented as a diffused resistor) to a prescribed reference potential, which corresponds to the potential of the first (negative) DC power supply voltage (here ground (GND) potential).

The output 203 of op amp 200 is coupled to the control terminal (gate) 01 of a current flow control device, shown as an NMOS field effect transistor (FET) M0, of an offset current generator 100, so that the source-drain current ($Id/Ic_{M0}$) through NMOSFET M0 is controlled in accordance with the output 203 of op amp 200. The source-drain current through NMOSFET M0 serves as the input current for a current mirror input PMOSFET M1 of a first current mirror circuit 300. For this purpose, current flow control NMOSFET M0 has its drain terminal 02 coupled to the commonly connected gate and drain terminals 11 and 13, respectively, of a current mirror input PMOSFET M1, the source terminal 12 of which is referenced to a prescribed positive DC voltage (e.g., +5.0 VDC). Current mirror circuit 30 has its output coupled to an output current reference node 35, from which a voltage Vout is derived, as will be described.

The source-drain current ($Id/Ic_{M0}$) through NMOSFET M0 is derived from of the positive +5.0 VDC reference and through the source-drain path of current mirror input PMOSFET M1 to which the drain terminal 03 of NMOSFET M0 is coupled. This source-drain current is supplied to an input current reference node 25, to which the source terminal 02 of NMOSFET M0 is connected. Input current reference node 25 is coupled in common with the inverting (−) input terminal 202 of op amp 200 and with the input of a reference current source 27. Reference current source 27 is operative to supply a prescribed reference current (e.g., 40 microamps) to the commonly connected gate and drain terminals 141 and 143, respectively, of a current mirror input PMOSFET M14 of a second current mirror circuit 400, the output of which is coupled to the output current reference node 35. PMOSFET M14 has its source terminal 142 coupled to a prescribed negative DC voltage (e.g., −2.0 VDC), which serves as the sink for the reference current supplied by reference current source 27 to current mirror input PMOSFET M14.

As will be described, as long as the monitored negative voltage differential applied to the input terminals 201 and 202 of op amp 200 is balanced or zero, the output 203 of op amp 200 is zero, so that current flow control NMOSFET M0 is slightly turned on, which allows a quiescent source-drain current, corresponding to that (e.g., 40 microamps) produced by the reference current source 27, to flow therethrough from current mirror input PMOSFET M1 of the first current mirror circuit 300 to the input current reference node 25. With reference current source 27 supplying this same value of current from the input reference current node 25 for application to the input PMOSFET M14 of current mirror circuit 400, no additional current will flow into or out of the input reference current node 25 by way of the inverting (−) input terminal 202 of op amp 200, to which grounded input resistor Rsense is coupled. As a consequence, the mirrored output currents supplied by current mirror circuits 300 and 400 to the output current reference node 35 will sum to zero or match.

As will be described, this will prevent any current from flowing into or out of output current reference node 35 through an output reference resistor Rref, which is used to provide, as necessary, an offset in the reference voltage being applied to an error amplifier 500, the output of which is used to control the DC power supply's positive voltage output. However, if the sensed remote voltage at the first input terminal RGND, to which the non-inverting (+) input terminal 201 of op amp 200 is coupled by way of input resistor R1, is different from the ground reference, to which the inverting (−) input terminal 202 of op amp 200 is coupled by way of resistor Rsense, the output 203 of op amp 200 will change accordingly, so as to cause the magnitude of source-drain current flowing through NMOSFET M0 to the input current reference node 25 to be different or offset from its (40 microamps) quiescent value.

The effect of this offset in the magnitude of the source-drain current flowing through NMOSFET M0 is to cause current to flow either in a first direction—from input current reference node 25 through input resistor Rsense to ground, or in a second direction from ground—through input resistor Rsense into input current reference node 25, depending upon the polarity of the departure of the monitored negative voltage from its intended or target value (e.g., ground). Namely, any offset in the sensed negative voltage from its target value is effectively converted into an equivalent current (the current through the input resistor Rsense) that is proportional to the offset in the sensed remote voltage at the first input terminal RGND. The direction and magnitude of this equivalent current is defined by the relatively simple relationship I=V−/Rsense, and is such as to bring the voltage V− applied to the inverting (−) input terminal 202 of op amp 200 into balance with the change in sensed remote voltage coupled to op amp input terminal 201.

The change in source-drain current through NMOSFET M0 necessary to bring the voltage V− at input terminal 202 into balance with the change in the sensed remote voltage is mirrored at the output of current mirror 300, so as to cause a mismatch in the magnitudes of the mirrored output currents supplied by current mirror circuits 300 and 400 to the output current reference node 35. This, in turn, causes current to flow either out of or into the output current reference node 35 through output reference resistor Rref (depending upon whether the source-drain current through MOSFET M0 is greater or less than the reference current generated by reference current source 27). Reference resistor Rref (which, like input resistor Rsense, may be implemented as a diffused resistor) is coupled to a positive target voltage reference node 45, to which a voltage Vdac, representative of the target voltage output of the power supply, is coupled. As pointed out above, any current flow through the reference resistor Rref will cause the voltage at node 35 to change relative to the voltage Vdac, so as to change the magnitude of the reference voltage applied to the error amplifier 500, and thereby a change in the error voltage used by the power supply's modulator loop to control the power supply's positive DC output voltage.

For this purpose, the first current mirror circuit 300 includes a current mirror PMOSFET M2 coupled in current mirror configuration with input PMOSFET M1. Current mirror PMOSFET M2 has its gate 21 coupled in common with the gate 11 of PMOSFET M1, its source 22 referenced to the prescribed positive DC voltage (+5.0 VDC), and its drain 23 coupled to the source 32 of a current mirror output PMOSFET M3, the drain 33 of which is coupled to the output current reference node 35. The gate 31 of PMOSFET M3 is coupled to the drain 93 of an NMOSFET M9 and to the drain 73 of a PMOSFET M7 of a first balancing amplifier 350 comprised of cascoded MOSFETs M6-M9 which serve to provide constant drain voltages for the first current mirror circuit 300. NMOSFET M9 has its source 92 coupled to a prescribed reference potential (ground), and its gate 91 coupled in common to the gate 81 and drain 83 of an NMOSFET M8, the source 82 of which is coupled to ground. The commonly connected gate 81 and drain 83 of NMOSFET M8 are connected to the drain 63 of a PMOSFET M6, the source 62 of which is coupled in common with the source 72 of PMOSFET 70 to receive a relatively small valued (e.g., five microamps) fixed bias current supplied by a reference current source 360. PMOSFET M6 has its gate 61 coupled to the drain 13 of input PMOSFET M1, while PMOSFET M7 has its gate 71 coupled to the drain 23 of current mirror PMOSFET M2.

In a similar, but polarity-complementary manner, the second current mirror circuit 400 includes a current mirror NMOSFET M4 coupled in current mirror configuration with input NMOSFET M14. Current mirror NMOSFET M4 has its gate 41 coupled in common with the gate 141 of NMOSFET M14, its source 42 referenced to the prescribed negative DC voltage (−2.0 VDC), and its drain 43 coupled to the source 52 of a current mirror output NMOSFET M5, the drain 53 of which is coupled to the output current reference node 35. The gate 51 of NMOSFET M5 is coupled to the drain 113 of a PMOSFET M11 and to the drain 133 of an NMOSFET M13 of a second current balancing amplifier 450 comprised of cascoded MOSFETs M10-M13 which serve to provide constant drain voltages for the second current mirror circuit 400. PMOSFET M11 has its source 112 coupled to a predetermined reference potential (e.g., +5.0 VDC), and its gate 111 coupled in common to the gate 101 and drain 103 of a PMOSFET M10, the source 102 of which is coupled to +5 VDC. The commonly connected gate 101 and drain 1083 of PMOSFET M10 are connected to the drain 123 of an NMOSFET M12, the source 122 of which is coupled in common with the source 132 of NMOSFET 13 to a relatively small valued (e.g., five microamps) fixed bias current source 460. NMOSFET M12 has its gate 121 coupled to the drain 114 of input NMOSFET M14, while NMOSFET M13 has its gate 131 coupled to the drain 43 of current mirror NMOSFET M4.

The output current reference node 35, to which the drains 33 and 53 of output MOSFETs M3 and M5 of current mirrors 300 and 400 are respectively coupled, is coupled to one end of reference resistor Rref, a second end of which is coupled to positive target voltage reference node 45 which, as described above, is coupled to receive a voltage Vdac, which corresponds to the output voltage of a digital-to-analog converter (DAC) that is used to set the target value of the positive voltage of the power supply. Output current reference node 35 is further coupled to a first, non-inverting (+) input 501 of error amplifier 500. A second, inverting (−) input 502 of error amplifier 500 is coupled to a feedback node FB from the control loop of the power supply's modulator 600 and, via a resistor R2, to the second input pin or remote voltage sensing terminal VSENSE. As described briefly above, this second input pin (VSENSE) is used by error amplifier 500 to monitor a second remote power supply terminal through which a second supply rail voltage, having some prescribed DC voltage value (e.g., +3.3 VDC) that is positive relative to the first voltage (ground), is supplied to a second power supply terminal of the powered device. A compensation network 550 comprised of series connected capacitor C1 and resistor R3, that are connected in parallel with capacitor C2 is connected between the inverting (−) input 502 and the output 503 of error amplifier 500. The output 503 of error amplifier 500 provides an error voltage that is used by the power supply's modulator loop to control the power supply's positive DC output voltage.

Operation

As pointed out above, using only the two input pins RGND and VSENSE, the remote differential voltage sensing architecture of the invention continuously monitors the voltages at the positive and negative supply terminals by way of which power is supplied from the power supply to a remote utility device and adjusts or offsets, as necessary, the value of the target reference voltage applied to the error amplifier 500, so as to realize an associated adjustment of the error voltage used by the power supply's modulator loop to control the power supply's positive DC output voltage. There are three modes of operation of the circuit: 1—monitored negative voltage rail at target value; 2—monitored negative voltage rail above target value; and 3—monitored negative voltage rail below target value.

1—Monitored Negative Voltage Rail at Target Value

In this mode, the value of the (negative) voltage monitored at the first (negative voltage rail-sensing) input pin RGND, which is coupled via input resistor R1 to the non-inverting (+) input terminal 201 of op amp 200, is at its target value (here zero volts or ground potential—corresponding to the value of the reference voltage coupled via input resistor Rsense to the inverting (−) input terminal 202 of op amp 200), so that the two inputs 201 and 202 of op amp 200 will be balanced (have a zero voltage differential therebetween). As a consequence, the output 203 of op amp is zero, so that current flow control NMOSFET M0 will be slightly turned on, as described above, to provide a prescribed quiescent source-drain current therethrough, corresponding to that (e.g., 40 microamps) produced by the reference current source 27, that flows out of the current mirror input PMOSFET M1 of the first current mirror circuit 300 and into the input current reference node 25. Since the reference current source 27, whose input is coupled to the input current reference node 25, supplies this same value of current to the input PMOSFET M14 of current mirror circuit 400, no additional current will flow into or out of the input reference current node 25 by way of the inverting (−) input terminal 202 of op amp 200, to which grounded input resistor Rsense is coupled.

As a consequence, the mirrored output currents supplied by current mirror circuits 300 and 400 to the output current reference node 35 will sum to zero, so that no additional current will flow out of or into node 35 relative to the positive target voltage reference node 45, by way of reference resistor Rref. With no current flowing (in either direction) through reference resistor Rref, there will be no associated voltage drop thereacross, so that the target positive voltage Vdac, which is representative of the target value of the positive voltage output of the DC supply, will be applied to the first, non-inverting (+) input 501 of error amplifier 500. As long as the value of the positive DC supply rail as monitored by the second input pin VSENSE is equal to its intended target value, the error out voltage from error amplifier 500 will be zero, so that the modulator's control loop will cause no change in the magnitude of the positive voltage output of DC supply. However, any difference between the value of the positive DC supply rail, as monitored by the second input pin VSENSE, from its intended target value at the positive target voltage reference node 45 and supplied therefrom to the reference input to the error amplifier 500, will cause the error amplifier 500 to generate a non-zero output or error voltage, in response to which the modulator's control loop will change the magnitude of the positive voltage output of DC supply to bring the monitored positive voltage to its intended target value.

2—Monitored Negative Voltage Rail Above Target Value

In this mode, the value of the (negative) voltage monitored at the first (negative voltage rail sensing) input pin RGND is more positive than its target value, so that the voltage at op amp input terminal 201 will be positive relative to the voltage at its input terminal 202. As a result, op amp 200 will increase the gate drive to NMOSFET M0, so as to increase the magnitude of its source-drain current being supplied to the input current reference node 25. As the magnitude of current being coupled from node 25 to the second current mirror 400 is fixed (e.g., at 40 microamps) by the reference current source 27, the increase in source-drain current into the input current reference node 25 will cause an offset current equal to that increase to flow out of node 25 and through the resistor Rsense to ground (which is at a lower potential than that of the positive voltage reference (+5 VDC) to which the input PMOSFET M1 of current mirror 300 is referenced).

This outward flow of current through resistor Rsense from the inverting (−) terminal 202 of op amp 200 to ground will cause a voltage drop across the resistor Rsense, that is effective to increase the voltage V− applied to the inverting (−) input terminal 202 of op amp 200, and thereby increase the value of the voltage V− at the inverting (−) input terminal 202 of op amp 200 toward the value of the voltage monitored at the input pin RGND and coupled to the non-inverting (+) input 201 of op amp 200. The inherent operation of operational amplifier 200 is such that the magnitude of its output (the gate drive to NMOSFET M0) will cause the resulting increase in source-drain current through NMOSFET M0 and through input resistor Rsense to bring the voltage V− at op amp input terminal 202 into balance with the positive change in the sensed remote voltage that is coupled to op amp input terminal 201.

This increase in the source-drain current through NMOSFET M0 that is necessary to bring the voltage V− at op amp input terminal 202 into balance with the change in the sensed remote voltage at op amp input terminal 201 increases the magnitude of the input current of current mirror input PMOSFET M1 of current mirror circuit 300, which is mirrored at the drain 33 of its associated current mirror output PMOSFET M3 and applied by output PMOSFET M3 to output reference current node 35. This results in a mismatch (corresponding the offset current through resistor Rsense) in the magnitudes of the mirrored output currents supplied by current mirror circuits 300 and 400 to output current reference node 35.

Because the magnitude of the current flowing into node 35 from PMOSFET M3 of current mirror circuit 300 is greater than the magnitude of the current flowing out of node 35 into NMOSFET M5 of current mirror 400, a current equal to that flowing through resistor Rsense will flow out of output current reference node 35 and through reference resistor Rref to the positive target voltage reference node 45. With current flowing through reference resistor Rref outwardly from node 35 to node 45, the resulting voltage drop across reference resistor Rref will be effective to increase the voltage Vout at node 35, relative to the voltage Vdac at the node 45. This increase in the value of the voltage Vout from its DAC-defined positive target voltage reference value supplied to node 45 will increase the value of the positive supply rail reference against which error amplifier 500 compares the positive DC supply rail as monitored by the second input pin VSENSE.

As a result, any adjustment of the positive output voltage by the DC power supply's correction loop will depend upon whether or not the monitored positive DC supply rail voltage (VSENSE) corresponds to an increased modification of the positive target value that takes into account the extent to which the negative DC supply rail has been detected to be above its target value, thereby ensuring that the intended differential between the positive and negative supply rails will be maintained.

3—Monitored Negative Voltage Rail Below Target Value

In this mode, the value of the (negative) voltage applied to the first (negative voltage rail sensing) input pin RGND is more negative than its target value, so that the voltage at op amp input terminal 201 will be negative relative to the voltage at its input terminal 202. As a result, op amp 200 will decrease the gate drive to NMOSFET M0, so as to reduce the magnitude of its source-drain current, which is supplied therethrough from current mirror input PMOSFET M1 to the input current reference node 25. Since the magnitude of current being coupled from node 25 to the second current mirror 400 is fixed (e.g., at 40 microamps) by the reference current source 27, this decrease in the amount of source-drain current through NMOSFET M0 into the input current reference node 25 will cause an offset current, that equal to the decrease in the magnitude of source-drain current through NMOSFET M0, to from ground through the resistor Rsense and into node 25. This inward flow of current through resistor Rsense from ground toward inverting (−) input terminal 202 of op amp 200 will cause a voltage drop across resistor Rsense, that is effective to decrease the voltage V− applied to the inverting (−) input terminal 202 of op amp 200. The inherent operation of operational amplifier 200 is such that the magnitude of its output (the gate drive to NMOSFET M0) will cause the resulting decrease in source-drain current through NMOSFET M0 and through input resistor Rsense to bring the voltage V− at op amp input terminal 202 into balance with the negative change in the sensed remote voltage that is coupled to op amp input terminal 201.

This decrease in the source-drain current through NMOSFET M0 that is necessary to bring the voltage V− at op amp input terminal 202 into balance with the negative change in the sensed remote voltage at op amp input terminal 201 decrease the magnitude of the input current of current mirror input PMOSFET M1 of current mirror circuit 300, which is mirrored at the drain 33 of its associated current mirror output PMOSFET M3 and applied by output PMOSFET M3 to output reference current node 35. This results in a mismatch (corresponding the offset current through resistor Rsense) in the magnitudes of the mirrored output currents supplied by current mirror circuits 300 and 400 to output current reference node 35.

Because the magnitude of the current flowing into node 35 from PMOSFET M3 of current mirror circuit 300 is less than the magnitude of the current flowing out of node 35 into NMOSFET M5 of current mirror 400, a current equal to that flowing through resistor Rsense will flow inwardly from the positive target voltage reference node 45 through reference resistor Rref and into the output current reference node 35. With current flowing through reference resistor Rref inwardly from node 45 to node 35, the resulting voltage drop across reference resistor Rref will be effective to decrease the voltage Vout at node 35, relative to the voltage Vdac at the node 45. This decrease in the value of the voltage Vout from its DAC-defined positive target voltage reference value supplied to node 45 will reduce the value of the positive supply rail reference against which error amplifier 500 compares the positive DC supply rail as monitored by the second input pin VSENSE.

As a result, any adjustment of the positive output voltage by the DC power supply's correction loop will depend upon whether or not the monitored positive DC supply rail voltage (VSENSE) corresponds to a decreased modification of the positive target value that takes into account the extent to which the negative DC supply rail has been detected to be lower its target value, thereby ensuring that the intended differential between the positive and negative supply rails will be maintained.

As will be appreciated from the foregoing description, by using a relatively simple circuit implementation (operational amplifier-controlled current mirror circuit) to monitor a single input pin coupled to a first (negative) power supply rail, through which a relatively negative one (e.g., ground) of a pair of supply rail voltages (such as ground and a positive DC voltage) is supplied to a positive supply terminal for the powered device, the two input pin-based DC power supply control circuit architecture of the present invention readily derives a current representative of the voltage differential between the negative supply rail and its target voltage. This derived current is then used to modify the input current to a current mirror circuit, whose mirrored output current is coupled through an output reference resistor, to produce an offset voltage of a magnitude and polarity that is defined in accordance with the magnitude and polarity of the derived current.

This offset voltage is added to or subtracted from a reference voltage for an error amplifier, to which a second input pin that monitors the second, relatively positive one of the pair of supply rail voltages is applied. The output of the error amplifier is then used by the power supply's modulator loop to adjust the power supply output. Because any adjustment of the positive output voltage by the DC power supply's correction loop not only depends upon whether or not the positive DC supply rail is at its target value, but whether or not the negative DC supply rail is at its target value, the invention readily ensures that the intended differential between the positive and negative supply rails will maintained.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art.

What is claimed is:

1. An apparatus for controlling the operation of a DC power supply comprising:

a first input terminal adapted to be coupled to a first remote power supply terminal, through which a first of a pair of supply rail voltages is supplied to a first supply terminal for a powered device;

a second input terminal adapted to be coupled to a second remote power supply terminal, through which a second of said pair of supply rail voltages is supplied to a second supply terminal for said powered device; and a control circuit, coupled to said first and second input terminals, and being operative to derive a current representative of a voltage differential between said first of said pair of supply rail voltages and a target value thereof, and to produce an offset voltage in accordance with said current, said offset voltage being used to modify a target value of said second of said pair of supply voltages to produce an error amplifier reference voltage that is compared in an error amplifier with a voltage derived by said second input terminal to produce an error voltage, in response to which a control loop for said DC power supply adjusts the power supply output, so as to ensure delivery of an appropriate value of said second of said pair of supply voltages to said second supply terminal of said powered device that maintains the intended DC voltage differential between said pair of supply rail voltages at said first and second supply terminals for said powered device.

2. The apparatus according to claim 1, wherein said control circuit includes:

an operational amplifier circuit having a first input coupled to said first input terminal, and a second input coupled through a sense resistor referenced to said first of said pair of supply rail voltages, and an output; and a controlled output current generator having a control input coupled to said output of said operational amplifier circuit, and a first node coupled to said second input of said operational amplifier, and being operative to controllably cause said current to flow through said sense resistor and said first node in accordance with the output of said operational amplifier circuit.

3. The apparatus according to claim 2, wherein said controlled output current generator includes a second node and is operative to produce an output current at said second node in association with said current representative of said voltage differential across said first and second supply terminals flowing through said first node, and further includes an output reference resistor, coupled to said second node and referenced to said target voltage, and being operative to controllably produce said offset voltage thereacross in accordance with flow of said output current therethrough.

4. The apparatus according to claim 3, wherein said controlled output current generator further includes a controlled current flow path, which is coupled to said control input so that current flow therethrough is controlled by said output of said operational amplifier circuit, and a reference current source coupled to said first node, and wherein said controlled output current generator is operative to controllably cause current to flow through said sense resistor in accordance with a difference between current flow through said controlled current flow path and reference current generated by said reference current source.

5. The apparatus according to claim 4, wherein said controlled current flow path is coupled between said first node and a first input current path of a first current mirror circuit, said first current mirror circuit having a first output current path coupled to said second node, and wherein said controlled output current generator further includes a second current mirror circuit having a second input current path coupled to said first node and a second output current path coupled to said second node, and wherein said output current produced at said second node is defined in accordance with first and second mirrored currents applied by said first and second current mirror circuits to said second node, in response to flow of said current through said first node representative of said voltage differential across said first and second supply terminals.

6. The apparatus according to claim 5, wherein said reference current source is coupled between said first node and said second input current path of said second current mirror circuit, so that said second current mirror circuit mirrors said reference current generated by said reference current source at said second output current path, and wherein said first current mirror circuit mirrors said current through said controlled current flow path at said first output current path, so that said output current produced at said second node is defined in accordance with first and second mirrored currents applied by said first and second current mirror circuits to said second node, in response to flow of said current through said first node representative of said voltage differential across said first and second supply terminals.

7. A method for controlling the operation of a DC power supply which is operative to provide first and second supply voltages to first and second supply terminals, respectively, of a powered device, said method comprising the steps of:

(a) monitoring a voltage at said first supply terminal, and a voltage at said second supply terminal;

(b) generating a first current representative of a voltage differential of said voltage monitored at said first supply terminal and a target value thereof;

(c) generating an offset voltage in accordance with said first current;

(d) modifying a target value of said second supply voltage in accordance with said offset voltage to produce an error amplifier reference voltage;

(e) comparing said error amplifier reference voltage and the voltage monitored at said second supply terminal to produce an error voltage representative of the difference therebetween; and (f) coupling said error voltage to a control loop for said DC power supply, which is operative to adjust the operation of said DC supply in accordance with said error voltage so as to ensure delivery of an appropriate value of said second supply voltage to said powered device that maintains the intended DC voltage differential between said first and second supply voltages at said first and second supply terminals, respectively of said powered device.

8. The method according to claim 7, wherein step (a) comprises monitoring said voltage at said first supply terminal by way of a first input of an operational amplifier circuit, said operational amplifier circuit having a second input coupled to a sense resistor referenced to said target value of said first supply voltage, and an output, and wherein step (b) comprises generating said first current in accordance with the output of said operational amplifier circuit, and causing said current to flow through said sense resistor so as to equalize voltages at and said first and second inputs of said operational amplifier.

9. The method according to claim 8, wherein step (c) comprises generating a second current in accordance with said first current and causing said second current to flow through an output reference resistor referenced to said target voltage, so as to produce said offset voltage thereacross in accordance with flow of said second current therethrough.

10. The method according to claim 8, wherein step (b) comprises coupling a controlled current flow path to a reference current source and said sense resistor and controlling flow of current through said controlled current flow path in accordance with the output of said operational amplifier circuit, and controllably causing current to flow through said sense resistor in accordance with a difference between current flow through said controlled current flow path and a reference current generated by said reference current source.

11. The method according to claim 10, wherein said controlled current flow path is coupled between a first node, that is coupled to said sense resistor and said reference current source, and a first input current path of a first current mirror circuit, said first current mirror circuit having a first output current path coupled to a second node, and wherein a second current mirror circuit has a second input current path coupled to said first node and a second output current path coupled to said second node, and wherein step (c) comprises generating a second current at said second node in accordance with first and second mirrored currents applied by said first and second current mirror circuits to said second node, in association with flow of said first current through said sense resistor, and causing said second current to flow through an output reference resistor coupled to said second node and referenced to said target voltage, so as to produce said offset voltage thereacross in accordance with flow of said second current therethrough.

12. The method according to claim 10, wherein step (d) comprises coupling said second node to said error amplifier, so as to provide said error amplifier reference voltage thereto.

13. An apparatus for controlling the operation of a DC power supply which is operative to provide first and second supply voltages to first and second supply terminals, respectively, of a powered device, said apparatus comprising:

a first monitoring terminal which is coupled to monitor a first voltage at said first supply terminal;

a second monitoring terminal which is coupled to monitor a second voltage at said second supply terminal:

a current generator, coupled to said first monitoring terminal, and being operative to generate a first current representative of a voltage differential between said first voltage monitored by said first monitoring terminal and a target value thereof:

an offset voltage generator, coupled to said current generator, and being operative to generate an offset voltage in accordance with said first current, and producing an error amplifier reference voltage representative of a modification of a target value of said second supply voltage by said offset voltage; and an error amplifier, coupled to said offset voltage generator and said second monitoring terminal, and being operative to produce an error voltage representative of the difference between said error amplifier reference voltage and said second voltage monitored by said second monitoring terminal, said error voltage being coupled to a control loop which is operative to adjust the operation of said DC supply in accordance with said error voltage, so as to ensure delivery of an appropriate value of said second voltage to said second supply terminal of said powered device that maintains the intended DC voltage differential between said first and second supply voltages at said first and second terminals, respectively.

14. The apparatus according to claim 13, wherein said current generator includes an operation amplifier having a first input coupled to said first voltage monitoring terminal, and a second input coupled to a sense resistor referenced to said first supply voltage, and an output, and a controlled current flow path having a control input coupled to said output of said operational amplifier, and a current flow path therethrough coupled to said sense resistor, and being operative to generate said first current in accordance with the output of said operational amplifier circuit, and to cause said current to flow through said sense resistor so as to equalize voltages at said first and second inputs of said operational amplifier.

15. The apparatus according to claim 14, wherein said current generator is operative to generate a second current in accordance with said first current, and wherein said offset voltage generator comprises an output reference resistor, referenced to a voltage representative of said target value of said second supply voltage, through which said second current flows and produces said offset voltage thereacross.

16. The apparatus according to claim 14, wherein said controlled current flow path is further coupled to a reference current source, and is operative to cause said first current to flow through said sense resistor in accordance with a difference between current flow through said controlled current flow path and a reference current generated by said reference current source.

17. The apparatus according to claim 16, wherein said controlled current flow path is coupled between a first node, that is coupled to said sense resistor and said reference current source, and a first input current path of a first current mirror circuit, said first current mirror circuit having a first output current path coupled to a second node, and wherein a second current mirror circuit has a second input current path coupled to said first node and a second output current path coupled to said second node, and wherein said current generator is operative to generate a second current at said second node in accordance with first and second mirrored currents applied by said first and second current mirror circuits to said second node, in association with flow of said first current through said sense resistor, and wherein said offset voltage generator is operative to cause said second current to flow through an output reference resistor coupled to said second node and referenced to said target value of said second supply voltage, so as to produce said offset voltage thereacross in accordance with flow of said second current therethrough.

* * * * *